United States Patent [19]

Selas

[11] 4,181,829

[45] Jan. 1, 1980

[54] TIME DELAY SWITCH ACTUATING MECHANISM

[75] Inventor: George J. Selas, Milwaukee, Wis.

[73] Assignee: Allen-Bradley Company, Milwaukee, Wis.

[21] Appl. No.: 895,729

[22] Filed: Apr. 12, 1978

[51] Int. Cl.[2] ..... H01H 43/00

[52] U.S. Cl. ..... 200/33 R; 200/34; 200/39 R

[58] Field of Search ..... 200/33 R, 34; 335/59, 335/60, 61, 67

[56] References Cited

U.S. PATENT DOCUMENTS

| | | | |
|---|---|---|---|
| 3,249,716 | 5/1966 | Haydu et al. | 335/39 |
| 3,585,321 | 6/1951 | Dennison | 200/34 |
| 3,797,616 | 3/1974 | Faffart et al. | 200/34 X |
| 3,833,778 | 9/1974 | Faffari | 200/33 |

*Primary Examiner*—James R. Scott
*Attorney, Agent, or Firm*—Quarles & Brady

[57] ABSTRACT

A time delay type of switch actuating mechanism is shown that can be assembled for either an "on delay" or "off delay" operation. A pair of contact carriers are mounted for linear motion, and a pivoted rocker member is joined between them for coordinating their movements. The rocker member has a lost motion connection with each contact carrier, and a catch is provided to restrain movement of the rocker and contact carriers until a timer performs a timing function. At the end of the timing interval the catch is released to permit a loaded spring to move the contact carriers and rocker to complete a switching function that is time delayed.

8 Claims, 12 Drawing Figures

Fig. 1
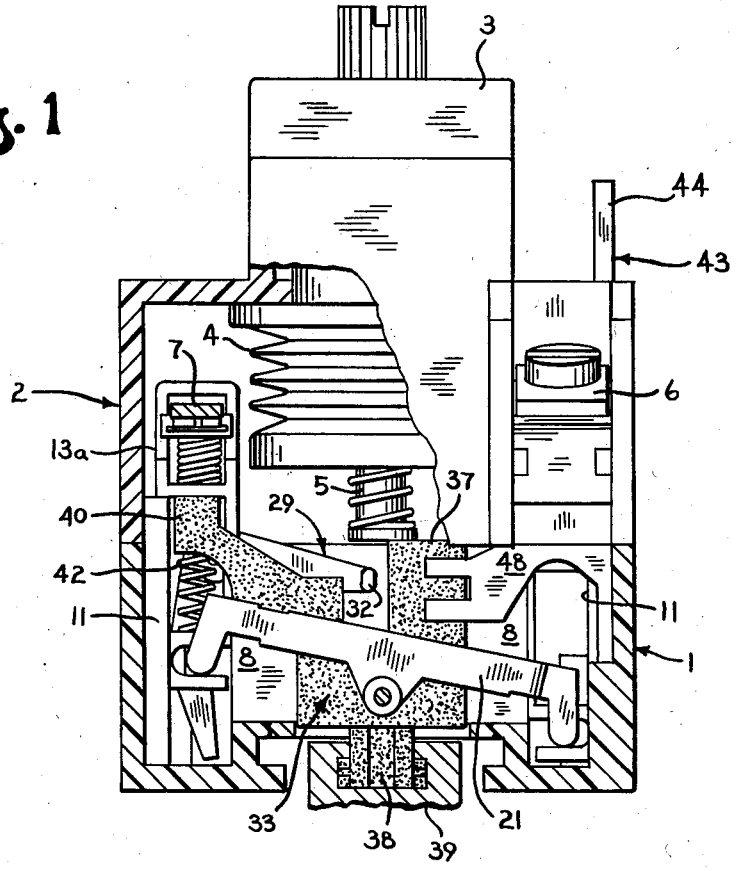
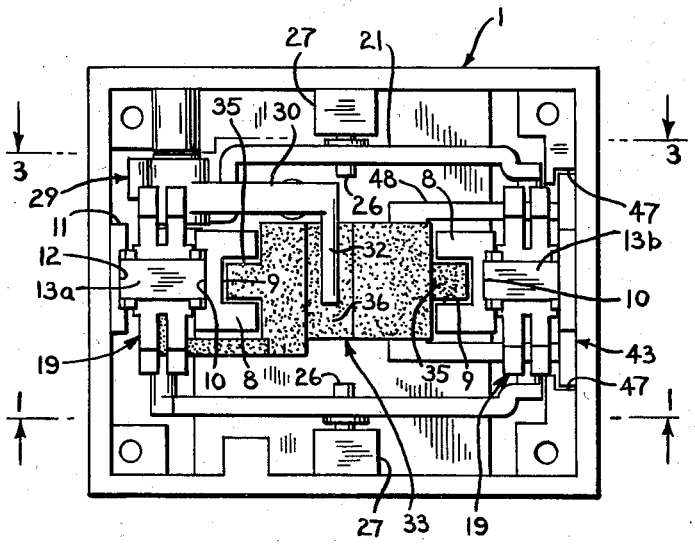
Fig. 2

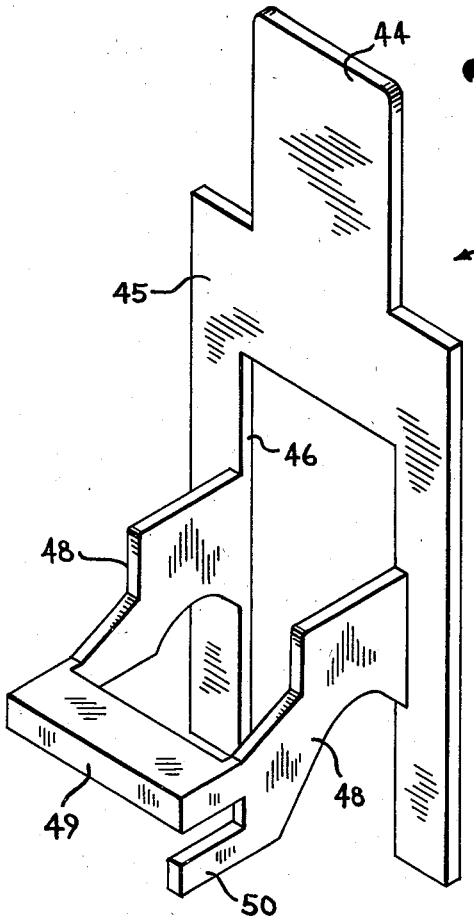
Fig. 5
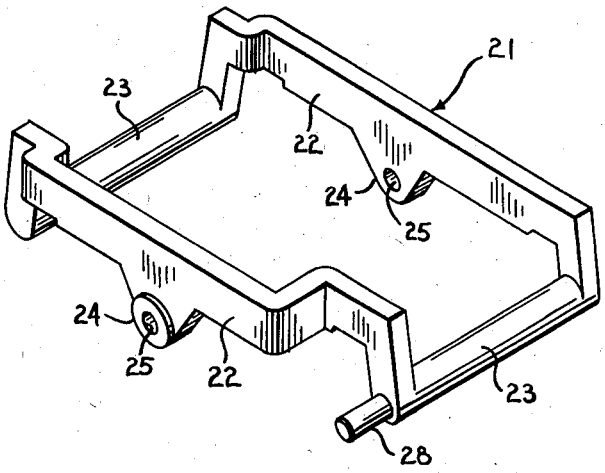
Fig. 6
Fig. 7
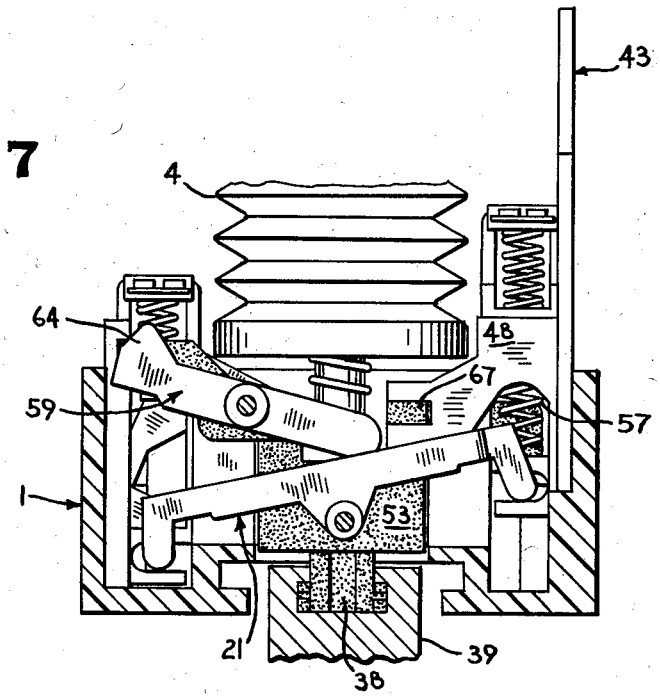

TIME DELAY SWITCH ACTUATING MECHANISM

BACKGROUND OF THE INVENTION

1. Field of the Invention

The time delay mechanism of the present invention is primarily intended for use in operating switch contacts in control circuits for governing machines and industrial processes.

2. Description of the Prior Art

It is frequently desired in the operation of electrical control circuits to delay the opening or closing of certain switch contacts for a brief interval following the action of the prime mover for the contacts. Thus, in an electromagnetic relay having a number of switch contacts it may be desirable to delay operation of some of the contacts after energizing or deenergizing the electromagnet in order to properly sequence the machine or process controlled by the relay.

To obtain a time delay of certain switch contacts, it is common practice to employ a timer in conjunction with the switch actuating mechanism to operate the contacts in response to the timer. The timing function of the timer commences upon the energization, or alternatively the deenergization of an associated electromagnet. The timer, the switch actuating mechanism, and the switch contacts that are time delayed are usually assembled as a unit, and the unit is adapted to be mounted on an electromagnetic relay as a separable attachment. Examples of such devices are shown in U.S. Pat. Nos. 3,249,716; 3,797,616 and 3,833,778.

The switch contacts of a time delay device are usually operated upon both energization and deenergization of the associated electromagnetic relay on which it is mounted, and the time delay mechanism for operating the switch contacts is connected directly to the armature of the relay. The time delayed operation of the switch contacts may occur when the electromagnet of the relay is energized, in which case it is said to be an "on delay", or the delay in operation may occur upon a deenergization of the electromagnet, in which case it is said to be an "off delay".

The timer that governs the duration of a delay is commonly of the pneumatic type, in which the rate of movement, or advance of a pulunger is controlled by admission of air to an expanding bellow. The pneumatically controlled plunger is held in a retracted position, and when the time delay function is to occur, upon an energization or deenergization of the relay, the bellows is free to expand, the thus advance the plunger through its stroke. Upon completing its timed advance, the plunger trips a spring loaded mechanism that operates the switch contacts with a resultant time delay. The aforementioned patents show typical forms of constructions employing pneumatic timers.

The form and arrangement of parts in a time delay mechanism to achieve an "on delay" is different from the form and arrangement of parts providing an "off delay". It is desirable, however, to have both "on delay" and "off delay" capabilities in the same basic structure with a minimal difference in parts. Mechanisms have appeared in the art that can be modified to provide one or the other type of delay by changing only a few parts, while retaining the same basic assemblage. An alternative type of arrangement appears in U.S. Pat., No. 3,249,716, wherein parts of both types of delay are permanently incorporated in the mechanism, and some parts are held dormant, or inoperable, while others are permitted to function. The present invention relates to the former arrangement, in which some of the parts in the switch actuating mechanism are substituted in order to select either an "on delay" or "off delay" operation.

SUMMARY OF THE INVENTION

The present invention resides in a time delay switch actuating mechanism in which a selected coupling member adapted to be driven by an associated relay has means, either as a part thereof or as an associated element, for restraining a timer plunger, and when operated by the relay releases the plunger and loads a contact actuating spring, so that when a catch is tripped by the timer plunger the spring is permitted to drive movable contacts in a time delayed motion for switch operation.

The mechanism for a time delay switch is quite complex, with several interfitting complex parts that wear against one another. Yet, it is desirable to incorporate into a time delay mechanism for operating switch contacts a structure having comparable life and reliability to that of other types of control devices that are to be found in control circuits. To obtain good life, and reliable contact actuation, the movable contacts of a preferred form of the present invention are mounted in carriers that have a guided, straight line motion. The carriers slide in closely conforming slideways having linear guiding surfaces. To synchronize the movement of a pair of contact carriers a tiltable frame extends between them, and has a lost motion connection with each carrier so that circular motion of the frame, which is occasioned by its pivoted mounting, is freely translated into linear motion for the contact carriers. A linear motion results for the movable, switch contacts that is in a line perpendicular to the stationary contacts. Sidewise sway, and wiping motion between stationary and movable contacts is minimized, and the abrasive wear associated with a wiping type of contact engagement is minimal.

The guideways for the contact carriers include columnar members that also double as guides for the coupling member that transmits motion from an associated electromagnetic relay to the parts of the time delay mechanism. By this dual use of the columnar members, the interior of the time delay mechanism is compactly arranged.

In control circuits comprising large numbers of relays it is often necessary to be able to manually test relay condition for purposes of maintenance, trouble shooting and repair. A manual operating member that can be depressed to physically move associated relay parts is included in the present structure. It drives a coupling, that forms a part of the time delay contact actuating mechanism, and the coupling connects directly with the relay. The movement of the coupling then provides a test for both the time delay mechanism of the invention and relay to which it is attached. The apparatus of the invention is also designed to provide either an "on delay" or "off delay" capability. Only a few parts need be substituted at the time of manufacture to have either one of the two modes of operation.

It is an object of the invention to provide a time delay mechanism in which the motion of movable contacts is linear.

It is another object of the invention to provide a time delay mechanism having a test function which will indicate the condition of operation of both the contacts of the mechanism, and of the relay to which the time delay device is attached.

It is another object of the invention to provide a compact assembly of parts of a time delay switch actuating mechanism in which the parts are arranged in an aligned fashion from one end to the other of the housing in which they are mounted.

It is another object of the invention to provide a time delay contact actuating mechanism that is housed in a base relatively remote from an associated timer and stationary contact region.

The foregoing and other objects and advantages of the invention will appear from the following description. In the description reference is made to the accompanying drawings which form a part hereof, and in which there is shown by way of illustration and not of limitation a preferred embodiment of the invention. Such embodiment does not represent the full scope of the invention, and reference is made to the claims herein for determining the breadth of the invention.

BRIEF DESCRIPTION OF THE DRAWINGS

FIG. 1 is a side view of a time delay switch mechanism embodying the present invention with parts broken away to view the interior of the device through the plane 1—1 indicated in FIG. 2, FIG. 2 is a top view of the switch mechanism of FIG. 1 with the housing cover removed, FIG. 5 is a view in perspective of a manual operator forming a part of the switch mechanism, FIG. 6 is a view in perspective of a rocker arm forming a part of the switch mechanism, FIG. 7 is a partial side view of the switch mechanism with parts installed therein for performing the "off delay" mode of operation, such view being of the base portion of the mechanism as seen through the plane 7—7 indicated in FIG. 8.

DESCRIPTION OF THE PREFERRED EMBODIMENT

Figure 3:
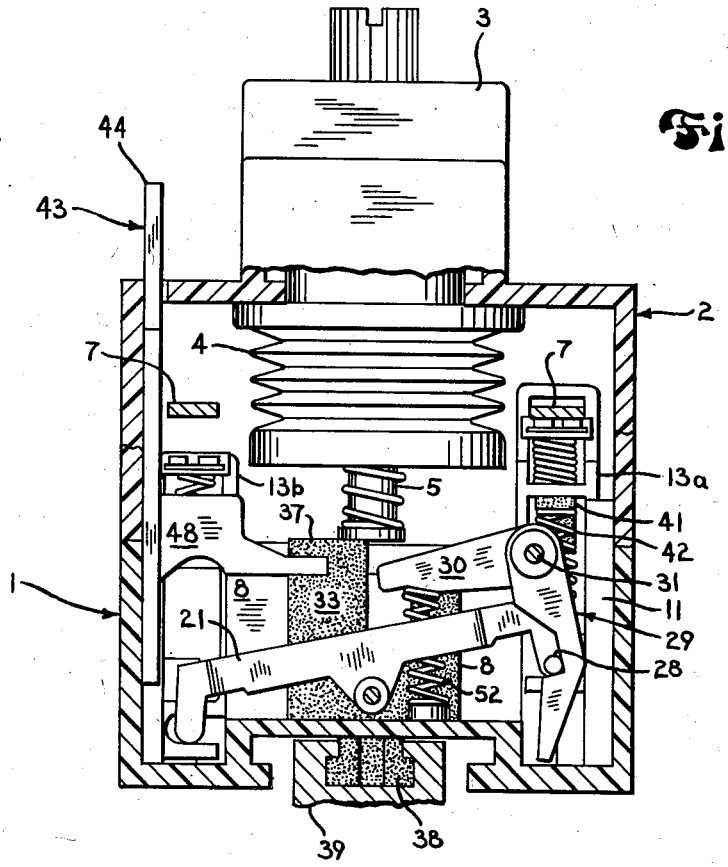
FIG. 3 is a side view in section of the switch mechanism taken from the opposite side of FIG. 1, and as seen through the plane 3—3 indicated in FIG. 2.

The time delay switch mechanism shown in the drawings can be arranged for either an "on delay" mode of operation, in which the associated switch contacts are delayed in their movement when the mechanism is initially operated by some external device such as the actuator of an electromagnetic relay, or the parts may be arranged by the substitution of some of its elements to have an "off delay" mode of operation, in which the movement of the associated switch contacts is delayed when the mechanism is returned to its original position, such as upon deenergization of the associated electromagnetic relay. The construction of the switch mechanism will first be described for the "on delay" mode of operation, and for this purpose reference is made to FIGS. 1–6 and 11.

The time delay mechanism, as shown, has a housing comprised of a molded, hollow base 1 having a bottom, side and end walls, and an open top, upon which is mounted a cover 2 that has side and end walls which seat upon the upper edges of the walls of the base 1. The cover 2 mounts a pneumatic timer 3 that includes an extendible bellows 4, seen in FIGS. 1 and 3, that depends into and is centrally located within the cover 2. The bellows 4 has a vertically movable plunger 5 at its lower end which cooperates with the switch mechanism of the invention for operation of associated switch contacts. The construction of the timer 3 is not a part of the present invention, and its function is to provide a means of controlling the rate of downward descent of an operating member such as the plunger 5, in order to achieve an adjustment for the period of time delay in operating the associated switch contacts. The timer 3 and its bellows 4 can be of a type as shown in co-pending application filed Apr. 12, 1978 entitled Adjustment for Pneumatic Timer and having Ser. No. 895,728. The cover 2 also mounts a number of terminals 6, one of which is shown at the right hand side in FIG. 1, that provide for electrical connection, and which extend into the cover 2 to present a set of stationary contacts 7.

Figure 11:
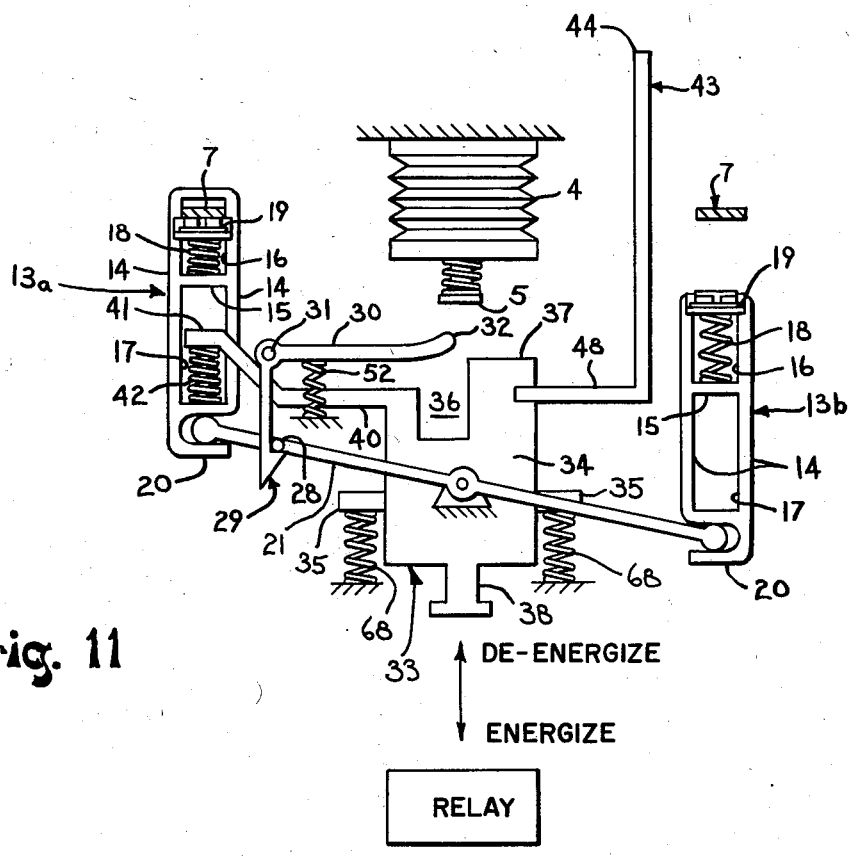
FIG. 11 is a schematic view of the switch mechanism as assembled in FIGS. 1–4 for the "on delay" mode of operation.

The hollow base 1 includes a pair of spaced column members 8 that rise upward from the base floor. As seen in FIG. 2, each column member 8 has a vertical channel 9 that forms a guideway facing toward the center of the base 1, so that the two channels, or guideways 9 face one another. Each column member 8 also has a relatively shallow, vertical groove 10 on its side opposite the channel 9 which faces outwardly toward an end wall of the base 1. A pilaster 11 is integrally formed on the interior of each base side wall in a position directly facing one of the grooves 10 of a column member 8. As best seen at the left hand side of FIG. 2, each pilaster 11 has a shallow trough 12 facing inwardly toward the associated groove 10, so that each groove 10 and its associated, facing trough 12 form a vertically extending slideway. A movable contact carrier 13*a* is mounted in one slideway, and a similar contact carrier 13*b* is mounted in the other slideway. The configuration of the contact carriers 13*a* and 13*b* is best shown in FIG. 11. Each contact carrier 13*a*, 13*b* has a pair of sides 14 having a considerable vertical extent. The sides 14 fit snugly within the slideways, so that each carrier 13*a*, 13*b* is guided in a straight line motion, as it reciprocates upwardly and downwardly.

A horizontal web 15 extends between the two vertical sides 14 of each contact carrier 13*a*, 13*b* to subdivide the space between the sides 14 into the upper spring cage 16 and a lower spring cage 17. The upper spring cage 16 houses a contact bias spring 18 which works against the underside of a movable contact 19. As best seen in FIG. 2, each contact 19 is of the bifurcated, bridging type that moves toward and away from a pair of spaced stationary contacts 7 for engagement and disengagement therewith, in order to make and break electrical continuity between terminals 6.

The lower end of each contact carrier 13*a*, 13*b* has an inwardly facing, hook-shaped bearing 20, and connected between the two bearings 20 is a rocker arm 21. The rocker arm 21 is shown in FIG. 6 as a rectangular frame having opposite side members 22. Connecting the ends of the side members 22 is a pair of cylindrically shaped bearing bars 23 that are received in the hook-shaped bearings 20 of the contact carriers 13*a* and 13*b*. Amidship each side member 22 is a downwardly protruding journal 24 with a crosswise opening 25 that is mounted on a wrist pin 26 extending inwardly from a gudgeon 27 that is an integral part of a side wall of the base 1. Thus, the rocker arm 21 can teeter-totter about its midpoint to raise and lower the cylindrical bearing bars 23. The bars 23, in turn, raise and lower the contact carriers 13*a*, 13*b* in unison, such that as one contact carrier ascends the other descends. The connections between the bearing bars 23 and the hook-shaped bearings 20 have a lost motion in the horizontal direction, so that the turning motion of the rocker arm 21 can be transferred into a straight line vertical motion.

As best seen at the lower right hand corner of FIG. 6, one side member 22 of the rocker arm 21 has an offset at one end, and a latch pin 28 that is concentric with one of the bearing bars 23 extends into the offset region. The latch pin 28 is in a position to be caught and retained by a catch 29, which is shown at the lower right hand side of FIG. 3. The catch 29 is adapted to restrain the rocker arm 21 from movement, so that the arm and contact carriers 13*a*, 13*b* are held in the position shown in FIGS. 1, 3 and 11. The catch 29 is mounted on a pivot pin 31, and has a complex configuration, including a lever arm 30 which extends radially outward from the pin 31. At the outer end of the lever arm 30 there is a finger 32, best seen in FIGS. 1 and 2, that extends beneath the plunger 5 of the extendible bellows 4. A catch spring 52, shown in FIG. 3, bears against the underside of the lever arm 30, so as to urge the catch 29 into a clockwise movement as seen in FIG. 3. The clockwise movement will keep the catch 29 against the latch pin 28, and not until the finger 32 and the lever arm 30 are depressed by a downward stroke of the plunger 5 will the catch 29 be rotated away from the latch pin 28 to permit a rocking motion of the rocker arm 21.

Figure 4:
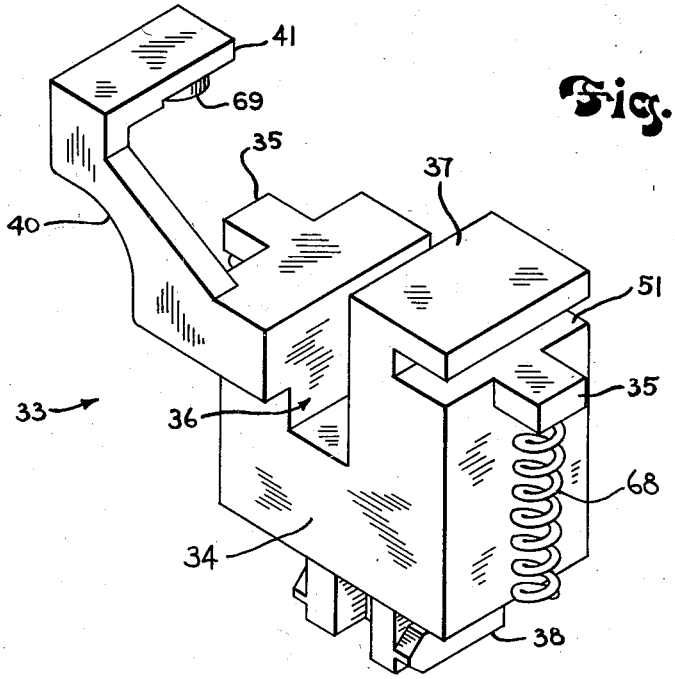
FIG. 4 is a view in perspective of a coupling member that forms a part of the switch mechanism when it is assembled for the "on delay" mode of operation.

An "on delay" coupling member 33 is shown in perspective in FIG. 4. This coupling member 33 is of complex configuration, and is mounted in the central region of the base 1. It is shown in mottling in FIGS. 1, 2 and 3 in order to better identify its location and shape. The coupling 33 has a blocklike, central body portion 34 which fills the space and fits between the two column members 8 of the base 1. A pair of projecting ears 35 extend from each end of the central body portion 34, and fit into the channels, or guideways 9 of the column members 8. This interfitting of parts is best seen in FIG. 2, and by the insertion of the ears 35 into the channels 9 the coupling member 33 is guided for vertical ascent and descent. A pair of return springs 68 are also located in the channels 9 directly beneath the ears 35. These springs 68 are not visible in FIGS. 1–3, but are shown in FIG. 4 in their associated position with the coupling member 33.

The coupling member 33 has a crosswise, central slot 36 which bifurcates the central body portion 34. This central slot 36 provides ample space for the finger 32 of the catch 29, so that as the coupling member 33 moves in its vertical motion it will not interfere with the finger 32. As seen in FIGS. 1 and 4, the part of the central body portion 34 to the right of the central slot 36, and which is identified by the numeral 37, is an elevated platform located directly beneath the bellows plunger 5. Thus, when the coupling member 33 is in its upper position, as shown in FIGS. 1 and 3, it will hold the bellows plunger 5 in a corresponding upper, or retracted position. Then, when the coupling members 33 descends the platform 37 is moved away from the plunger 5, to permit the bellows 4 to expand at a controlled rate and advance the plunger 5 downward toward the finger 32 of the catch 29. When the plunger 5 depresses the finger 32 the catch 29 is rotated out of its locking position with the latch pin 28.

A coupler 38 projects downwardly from the underside of the central body portion 34 of the coupling member 33. As seen in FIGS. 1 and 3, the coupler 38 is shaped to connect with the upper end of an actuator 39 of an electromagnetic relay (not shown). The tongue and groove connection between the coupler 38 and the relay actuator 39 provides a positive coupling between these members, so that as the relay actuator 39 is moved upwardly and downwardly in response to electrical energization and deenergization of the relay the coupling member 33 will slavishly follow the motion of the actuator 39.

Time delay switch mechanisms are commonly connected to relay actuators, so as to function in response to an operation of the associated relay. The construction of such a relay is not part of the invention, so that only a fragmentary portion of the actuator 39 is shown. The actuator 39 will be in its upper position, which is that shown in FIGS. 1 and 3, when the electromagnetic relay is deenergized. Then, when the relay is energized the actuator 39 will be moved downward. The energization of the relay may be characterized as an "on" operation, and the motion of the movable contacts 19 will be time delayed. Hence the expression "on delay" is used to describe a lagging contact movement after an associated electromagnetic relay is energized.

Referring back to the configuration of the coupling member 33, it has an obliquely rising spring loading arm 40 that rises upwardly to the left as seen in FIGS. 1 and 4. The upper end of the arm 40 turns horizontally to provide a spring abutment 41 that extends into the lower spring cage 17 of the contact carrier 13*a*. inserted between the lower face of the spring abutment 41 and the bottom of the lower spring cage 17 is a load spring 42. The upper end of the spring 42 is seated around a boss 69 on the spring abutment 41. This spring 42 is compressed upon a downward motion of the coupling member 33 and its spring abutment 41, to thereby load the spring and apply a downward pressure against the associated contact carrier 13*a*.

To complete the assembly of the "on delay" form of the invention, there is a manual operator 43 shown in perspective in FIG. 5. It has a manually engageable upper end 44 that protrudes upward from the top of the cover 2, and consists of a vertically disposed flat plate member 45 with a central opening 46. The opening 46 encircles the contact carrier 13*b* and its associated pilaster 11. The sides of the pilaster 11 thus guide the vertical movement of the manual operator 43. The lower end of the operator 43 is confined in notches 47 formed in the base 1, as shown in FIG. 2, to retain the operator 43 in its upright position.

As seen in FIG. 5, the manual operator 43 has a pair of horizontally extending legs 48 that are bridged at their remote ends by a crossbar 49. At one end of the crossbar 49 there also is an attachment hook 50. In the "on delay" assemblage of the switch actuating mechanism the crossbar 49 engages the coupling member 33 by fitting within a horizontal kerf 51 formed in the platform portion 37 of the member 33. Thus, if the manual operator 43 be depressed by pushing downward against its upper end 44 the coupling member 33 will be similarly depressed. This simulates a downward thrust of the relay actuator 39 to provide a test for the mechanism, to see if the contacts are operating properly with a time delay. The downward thrust imparted to the relay actuator 39 will also enable a test of relay contacts that are associated with the electromagnet. Thus, the manual operator 43 by virtue of its connection with the coupling member 33 provides a test for both the mechanism of the invention and of any associated relay structure.

OPERATION OF "ON DELAY"

The operation of the "on delay" form of the invention may now be described. When the electromagnetic relay is in its normal, deenergized state the actuator 39 is in its upper position, as shown in FIGS. 1 and 3. The coupling member 33 is similarly in its upper position, and the platform portion 37 holds the plunger 5 of the pneumatic timer 3 in its retracted position in which the bellows 4 is collapsed. The upper surface of the spring abutment 41 at the end of the arm 40 of the coupling 33 supports the web 15 of the contact carrier 13*a* to lift the carrier 13*a* into its raised, contact closed position. The rocker arm is then tilted as shown in FIGS. 1 and 3 to hold the contact carrier 13*b* in its lower, contact open position. The latch pin 28 is engaged by the catch 29 to restrain the rocker arm 21 from moving out of position, and the parts described are all in the normal, off position.

If the associated electromagnetic relay is now energized, so as to have an "on" condition the actuator 39 is pulled downward. The coupling member 33 is similarly pulled downward, and the spring abutment 41 then descends to compress the load spring 42 against the bottom of the contact carrier 13*a*. The spring 42 will remain loaded, or compressed, because the catch 29 is holding the latch pin 28 so that the rocker arm 21 and carriers 13*a*, 13*b* cannot move. The descent of the coupling member 33 has, however, freed the bellows plunger 5, and the bellows is now free to expand at a rate set by adjustment of the pneumatic timer 3. This position of the parts, with the bellows commencing to expand is shown in FIG. 11.

The plunger 5 descends at a slower rate than occurred for the abrupt, downward travel of the coupling member 33, and there will be a predetermined time interval until the plunger 5 advances through its downward stroke and strikes the finger 32 of the catch 29. When the plunger 5 strikes the finger 32 the catch 29 is rotated against its spring 52 to release the latch pin 28. Upon release of the latch pin 28 the load spring 42 immediately moves its contact carrier 13*a* downward with a fast contact opening motion. The rocker arm 21 simultaneously turns about its pivot, and contact carrier 13*b* is moved upward into contact closing position. Thus, switch contact action takes place with a time delay after energizing the prime mover, or relay, to its "on" condition.

When the relay is deenergized and moves to its "off" position the actuator 39 and the "on delay" coupling member 33 return to their raised positions. The contact carriers 13*a*, 13*b* and rocker arm 21 are simultaneously operated to their normal positions of FIGS. 1 and 3. To assist the upward travel of the coupling member 33 the return springs 68 push upward against the undersides of the ears 35, and thus relieve some of the load from the internal springs of the associated relay.

"OFF DELAY" MODE OF OPERATION

Figure 8:
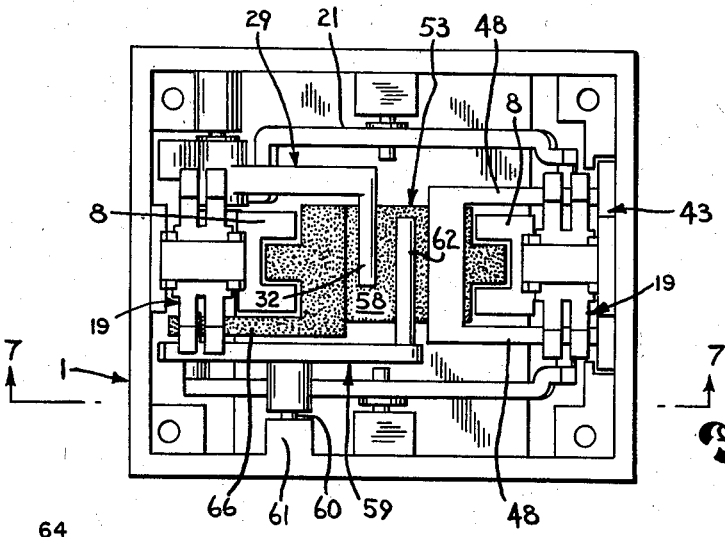
FIG. 8 is a top view of the switch mechanism of FIG. 7.
Figure 9:
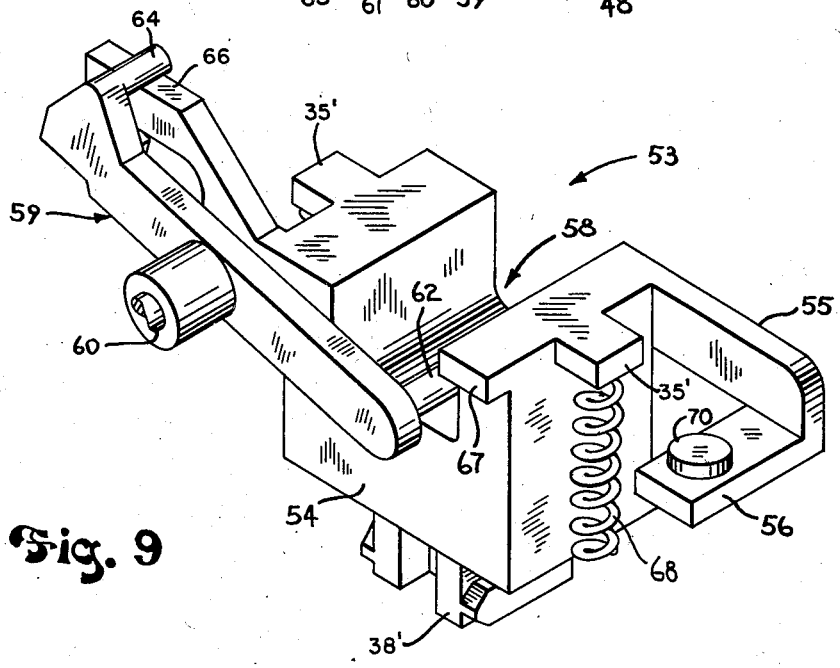
FIG. 9 is a view in perspective of a coupling member and associated bellows reset lever that are installed in the switch mechanism for performing the "off delay" mode of operation.
Figure 10:
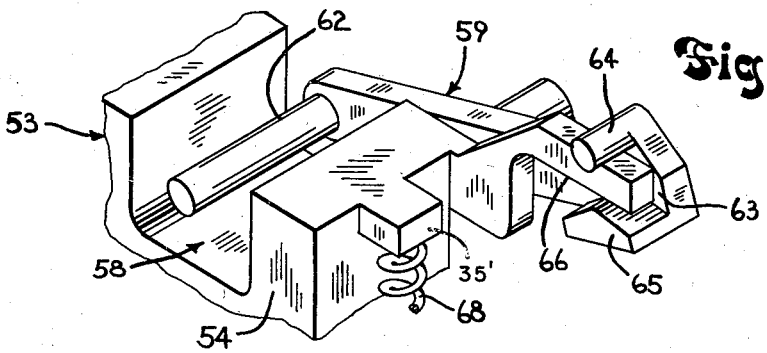
FIG. 10 is a fragmentary view in perspective of a portion of the parts shown in FIG. 9 taken from the opposite end of such parts.

The time delay switch mechanism that has been described can be arranged for an "off delay" operation by the removal of the coupling member 33 and the substitution therefor of the two elements shown in FIGS. 9 and 10. These substituted elements are shown assembled into the mechanism in FIGS. 7, 8 and 12, and taken together may be deemed a coupling means that takes the place of the coupling means for "on delay" operation. All other parts remain the same as in the "on delay" mode of operation, and the same reference numerals are applied to them as in FIGS. 1–3, 4–6 and 11.

Referring particularly to FIG. 9, there is shown an "off delay" coupling member 53 which has a blocklike central portion 54. This central portion 54 fits between the two column members 8 of the base 1, and has projecting ears 35′ (that are like the ears 35 of the coupling member 33) that fit in the channels 9, so that the "off delay" coupling member 53 is guided for vertical movement similarly as the "on delay" coupling member 33. At the bottom of the central portion 54 is a coupler 38′ (like the coupler 38) which fastens to the relay actuator 39.

The coupling member 53 has a horizontally extended spring loading arm 55 that turns at its outer end to form a spring abutment 56 which extends into the lower spring cage 17 of the contact carrier 13*b*. A load spring 57 is inserted between the top of the spring abutment 56 and the lower face of the web 15 of the carrier 13*b*. The lower end of the spring 57 is seated around a boss 70 on the spring abutment 56. The central portion 54 of the coupling member 53 has a large open center 58, and as seen in FIG. 7 this open center 58 extends to both sides of the bellows plunger 5, so that in the "off delay" mode of the invention the coupling member 53 does not engage the bellows plunger 5.

Associated with the coupling member 53 is a bellows reset lever 59, that is shown in place with member 53 in perspective in FIGS. 9 and 10. The bellows reset lever 59 is pivoted at its mid-point, as seen in FIGS. 7 and 8, on a pin 60 projecting from a boss 61 formed as an integral part of a side wall of the base 1. The lever 59 has a finger 62 at one end which extends into the open center 58. This finger 62 lies beside the finger 32 of the catch 29, so that both fingers 32, 62 are beneath and in the path of travel of the plunger 5.

As best seen in FIG. 10, the bellows reset lever 59 has a socket 63 at its end opposite the finger 62 which is made up of a spaced toe 64 and heel 65. The socket 63 receives a strut 66 that projects outward from the central portion 54 of the coupling member 53, so that as the coupling member 53 is raised and lowered the lever 59 is pivoted about its middle in order to raise and lower its finger 62.

The "off delay" coupling member 53 and the associated bellows reset lever 59 are shown installed in the base 1 in FIGS. 7 and 8, with the coupling member 53 being mottled for better identification of this part. The manual operator 43 is joined to the coupling member 53 by insertion of a ledge 67 on the member 53 into the attachment hook 50 of the manual operator 43. Thus, as the manual operator 43 is moved up and down the coupling member 53 will be similarly moved in order to have a test of both the time delay mechanism of the invention and of the associated electromagnetic relay and its contacts and parts.

The "off delay" assemblage will cause a time delay in the actuation of the movable contacts 19 upon a deenergization, or turning off the associated electromagnetic relay. When the parts are at rest, before the associated electromagnetic relay is operated, they are in the position shown in FIG. 7. When the relay is energized the actuator 39 and coupling member 53 are pulled downward. The spring abutment 56 also moves downward, and carries its associated contact carrier **13*b* in a similar downward stroke. This causes the rocker arm 21 to pivot so that the opposite contact carrier 13*a* is raised. As a result there is a switch actuation that occurs simultaneously with relay energization. As the rocker arm 21 is pivoted the latch pin 28 moves upward into engagement with the catch 29, so that it becomes locked in place. One other function occurs at this point in time, and that is a pivoting of the bellows reset lever 59 to raise its finger 62 upwardly against the underside of the bellows plunger 5** to hold it in the elevated, retracted position. The parts in the mechanism are now in position to perform a delayed contact actuation upon a deenergization, or return of the associated relay to its "off" condition.

Figure 12:
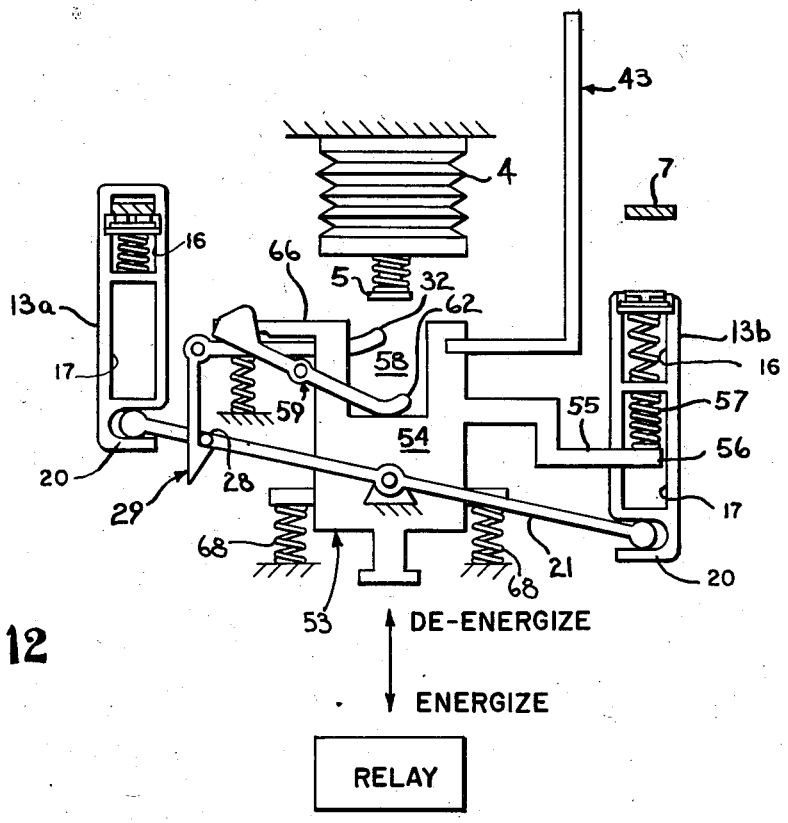
FIG. 12 is a schematic view of the switch mechanism with parts assembled for the "off delay" mode of operation.

Now, when the electromagnetic relay is deenergized, the relay actuator 39 and the "off delay" coupling member 53 will rise, to return to the position shown in FIGS. 7 and 12. This causes a pivoting of the bellows reset lever 59, so that its finger 62 is retracted away from the bellows plunger 5. At the same time, the spring loading arm 55 and its spring abutment 56 are moved upwardly to compress the associated load spring 57. The spring 57 will urge its associated contact carrier **13*b* upward, but the carrier 13*b* is held from movement because of the locked condition of the rocker arm 21. The parts of the mechanism are now in the position of FIG. 12, and the bellows 4 can expand to move the plunger 5** downward.

As the bellows plunger 5 descends it will strike the finger 32 of the catch 29, to release the catch and allow the rocker arm 21 to pivot. The force of the loaded spring 57 moves the contact carrier **13*b* upwardly for contact engagement, and pivots the rocker arm 21 to drive the other contact carrier 13*a* downwardly to open its respective contacts. This switch movement occurs with a time delay having an interval dependent upon adjustment of the pneumatic timer 3**.

Thus, the invention provides a time delay switch mechanism that can be assembled for either an "on delay" or an "off delay" operation. The switch contacts are guided for straight line motion that ensures optimum contact operation. The coordination of the two sets of contacts is accomplished by a pivoted member, and a lost motion connection is provided between this member and each contact carrier, in order to preserve the linear contact movement. The parts are compactly assembled and the base that houses the mechanism is provided with guideways and slideways that utilize the available space in an efficient manner. In this assemblage, the rocker arm required for coordinating the contact motions is located in the lower part of the base and encircles the coupling member and guiding columns in the base. This arrangement allows for confining the switch actuating mechanism to the lower part of the housing, so as not to interfere with the timer and its expandible bellows. Also upon a removal of the timer part of the apparatus the movable contacts protrude from the remainder of the mechanism for ease of inspection and maintenance.

I claim:

1. In a time delay switch mechanism having a timer with an output member that is advanced from a retract position at a preselected rate of travel to perform a timing function, the combination comprising:

a pair of upright column members spaced from one another to present a guideway therebetween that is beneath said timer output member;

a coupling member reciprocally mounted in said guideway having means associated therewith for holding said timer output member in its retract position, and also having a spring loading arm movable therewith;

a pair of upright members, each spaced from one of said column members on a side opposite said coupling member, to form a pair of slideways with the column members;

a movable contact carrier in each slideway that is guided thereby for linear motion;

a load spring interposed between one of said contact carriers and said spring loading arm of said coupling member;

an open centered frame encircling said coupling member and said column members, and connecting with each of said contact carriers at its opposite ends, said frame being pivotally mounted medial its ends for rocking motion that moves said contact carriers in unison; and a catch adapted to engage said open centered frame to restrain said frame from movement, and having an operating finger extending into the path of advance of said timer output member to be struck and moved thereby to release the catch.

2. In a time delay switch mechanism having a timer with an output member that is advanced from a retract position at a preselected rate of travel to perform a timing function, the combination comprising:

(a) a housing base portion having:

(i) guide means at each end for defining an outer side of a respective linear slideway adjacent that end, (ii) a pair of upright column members that are spaced from one another to present a guideway therebetween, each column member also being spaced from the guide means at a respective end to define an inner side of the linear slideway adjacent that end, and (iii) a pair of pivot points on opposite sides of said guideway which are medial of said slideways;

(b) a housing cover portion above said base portion mounting said timer with the output member thereof disposed above said guideway, and including stationary contacts disposed above said slideways;

(c) a pair of movable contact carriers, each in one of said slideways for a guided linear motion, each carrier mounting a movable contact for engagement and disengagement with stationary contacts, and also including a spring cage adapted to receive a load spring;

(d) a rocker frame in said housing base portion that has side arms bordering said guideway and columns that are pivoted medial their ends to said pivot points for rocking movement, and also having crosswise portions that have lost motion connections with said contact carriers for translation of circular frame motion to straight line carrier motion;

(e) a catch having an operating finger extending into the path of advance of said timer output member to be struck and moved thereby, and having a catch portion adapted to engage said frame to restrain the frame and said contact carriers from movement until a release thereof;

(f) coupling means having:

(i) a reciprocally movable body portion in said guideway for sliding, guided movement toward and away from said timer output member, and being adapted for connection to a source of motion, (ii) a spring loading arm extending into one of said spring cages of said movable contact carriers, and (iii) means for restraining said timer output member while said coupling means is at one position of reciprocation, and retreating from said output member upon said coupling means moving from such position; and (g) a load spring in said one of said spring cages interposed between said spring loading arm and the contact carrier to be compressed by motion of said arm.

3. A mechanism as in claim 2, in which said means for restraining said timer output member comprises a platform forming a part of the coupling means body portion.

4. A mechanism as in claim 2, in which said means for restraining said timer output member comprises a pivoted lever having a finger moved toward said output member upon movement of said coupling means body portion away from said timer output member.

5. In a time delay switch mechanism having a timer with an output member that is advanced from a retract position at a preselected rate of travel to perform a timing function, the combination comprising:

(a) a hollow, housing base portion having:

(i) a pair of interior surfaces at opposite ends of the base portion, (ii) a pair of column members, rising from the bottom that are each spaced inward from a respective interior end surface to form a slideway, said column members also being spaced from one another to present a guideway therebetween, and (iii) a pair of pivot points on opposite sides of said guideway which are medial of said slideways;

(b) a housing cover portion atop said base portion mounting said timer with the output member thereof disposed above said guideway to advance thereto and retract therefrom, and also mounting stationary contacts that are disposed above said slideways;

(c) a pair of movable contact carriers, each in one of said slideways for a linear, sliding, reciprocal motion, and each carrying a movable contact for engagement and disengagement with stationary contacts above the associated slideway, said carriers also each having a spring cage adapted to hold a load spring;

(d) a rocker arm in the form of an open centered frame in said housing base portion that surrounds said columns and the guideway therebetween which has side members pivoted medial their ends to said pivot points for rocking movement, and that has crosswise portions in lost motion connections with said contact carriers for translation of a circular frame motion to straight line carrier motion;

(e) a latch member carried by said open centered frame;

(f) a pivoted catch having an operating finger extending into the path of advance of said timer output member to be struck and moved thereby, and adapted to engage said latch member to restrain said frame and said contact carriers from movement until pivoted movement of said catch releases said latch member;

(g) a bias spring acting upon said catch to urge said catch operating finger toward said timer output member and to urge said catch into engagement with said latch member;

(h) coupling means having;

(i) a body portion in said guideway for guided, sliding movement with respect to said columns and adapted to be reciprocated by a source of motion, (ii) a spring loading arm extending into one of said spring cages of said movable contact carriers, and (iii) means for restraining said timer output member when said coupling means is in one position of reciprocation, and which retreats from said output member upon said coupling means being moved away from said position of reciprocation; and (i) a load spring in said one of said spring cages interposed between said spring loading arm portion and the contact carrier to be compressed by motion of said arm to urge movement of the contact carrier, the rocker arm and the other contact carrier.

6. A mechanism as in claim 5, in which said means for restraining said timer output member comprises a platform forming a part of the coupling means body portion.

7. A mechanism as in claim 5, in which said means for restraining said timer output member comprises a pivoted lever having a finger moved toward said output member upon movement of said coupling means body portion away from said timer output member.

8. A mechanism as in claim 5, having a manual test member connected to said coupling means for simultaneous movement of the test member and coupling means.

* * * * *